United States Patent [19]

Chibana

[11] 4,083,285

[45] Apr. 11, 1978

[54] ELECTRONIC MUSICAL INSTRUMENT

[75] Inventor: Masanobu Chibana, Hamamatsu, Japan

[73] Assignee: Nippon Gakki Seizo Kabushiki Kaisha, Japan

[21] Appl. No.: 615,953

[22] Filed: Sep. 23, 1975

[30] Foreign Application Priority Data

Sep. 27, 1974 Japan ..... 49-111818
Oct. 4, 1974 Japan ..... 49-114346

[51] Int. Cl.[2] ..... G10H 1/02

[52] U.S. Cl. ..... 84/1.26; 84/1.13; 84/1.24; 84/1.11; 84/1.19

[58] Field of Search ..... 84/1.01, 1.11, 1.12, 84/1.13, 1.19, 1.21, 1.26, 1.23

[56] References Cited

U.S. PATENT DOCUMENTS

| | | | |
|---|---|---|---|
| 3,610,805 | 10/1971 | Watson et al. | 84/1.13 |
| 3,610,806 | 10/1971 | Deutsch | 84/1.13 X |
| 3,636,231 | 1/1972 | Schrecongost et al. | 84/1.11 X |
| 3,809,786 | 5/1974 | Deutsch | 84/1.01 |
| 3,844,379 | 10/1974 | Tomisawa et al. | 84/1.13 X |
| 3,882,751 | 5/1975 | Tomisawa et al. | 84/1.11 X |
| 3,894,463 | 7/1975 | Rocheleau | 84/1.11 X |
| 3,908,504 | 9/1975 | Deutsch | 84/1.26 X |
| 3,910,150 | 10/1975 | Deutsch et al. | 84/1.13 X |
| 3,913,442 | 10/1975 | Deutsch | 84/1.13 X |

*Primary Examiner*—Ulysses Weldon
*Attorney, Agent, or Firm*—Ladas, Parry, Von Gehr, Goldsmith & Deschamps

[57] ABSTRACT

The electronic musical instrument according to the invention is capable of controlling each level of harmonics constituting a musical tone individually and independently from each other and thereby producing a musical tone which is a close simulation of a natural musical tone. In order to produce change in the level of each harmonic with the lapse of time separately and independently, information respectively representing a peak level of attack, attack time from start of generation of a tone to the peak level, a sustain level and decay time from the peak level to the start of the sustain level is memorized for each harmonic and the level of each harmonic is controlled in response to such information.

In one example of the electronic musical instrument, the level of each harmonic constituting a musical tone is amplitude-modulated with a different period and depth.

4 Claims, 13 Drawing Figures

ELECTRONIC MUSICAL INSTRUMENT

BACKGROUND OF THE INVENTION

This invention relates to an electronic musical instrument capable of controlling each level of harmonics constituting a musical tone individually and independently from each other.

It is a characteristic of a tone color produced by a natural musical instrument that levels of harmonics constituting the musical tone change in a complicated manner with the lapse of time at the start of reproduction of the musical tone.

This change in the levels of harmonics is particularly remarkable at the very start of reproduction of the tone.

In conventional electronic musical instruments, relative ratios of respective harmonics are fixed at constant values depending upon a musical tone to be produced. As a result, there occurs lack in naturalness in the produced musical tone. Furthermore, according to the conventional electronic musical instruments, a musical tone in a normal state produced after the lapse of the transient period is of such a constant tone color that it tends to give a monotonous impression to the audience.

SUMMARY OF THE INVENTION

It is an object of this invention to provide an electronic musical instrument which has eliminated the above described disadvantages of the prior art electronic musical instrument.

According to the invention, the electronic musical instrument is capable of separately controlling levels of harmonic contents constituting the musical tone and thereby producing a musical tone which is a closer simulation of a natural musical tone.

It is another object of the present invention to provide an electronic musical instrument capable of providing a desired change in the level of each harmonic constituting the musical tone in the attack and decay portions of the tone at the start of reproduction thereof and thereby producing a musical tone which closely resembles a natural musical tone by virtue of the subtle change in the tone color at the start of reproduction of the tone.

It is still another object of the invention to provide an electronic musical instrument capable of amplitude modulating the level of each harmonic constituting a musical tone with different period and depth and thereby producing a musical tone with a rich, complicated tone color free from monotonousness.

These and other objects and features of the invention will become apparent from the description made hereinbelow with reference to the accompanying drawings.

DETAILED DESCRIPTION OF THE INVENTION

Figure 1:
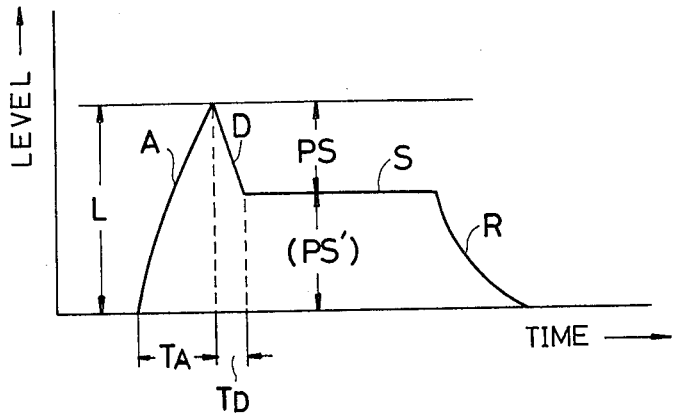
FIG. 1 is a graphic diagram showing an example of mode of change occuring in the harmonic level controlled by one embodiment of the electronic musical instrument according to the invention.
Figure 10:
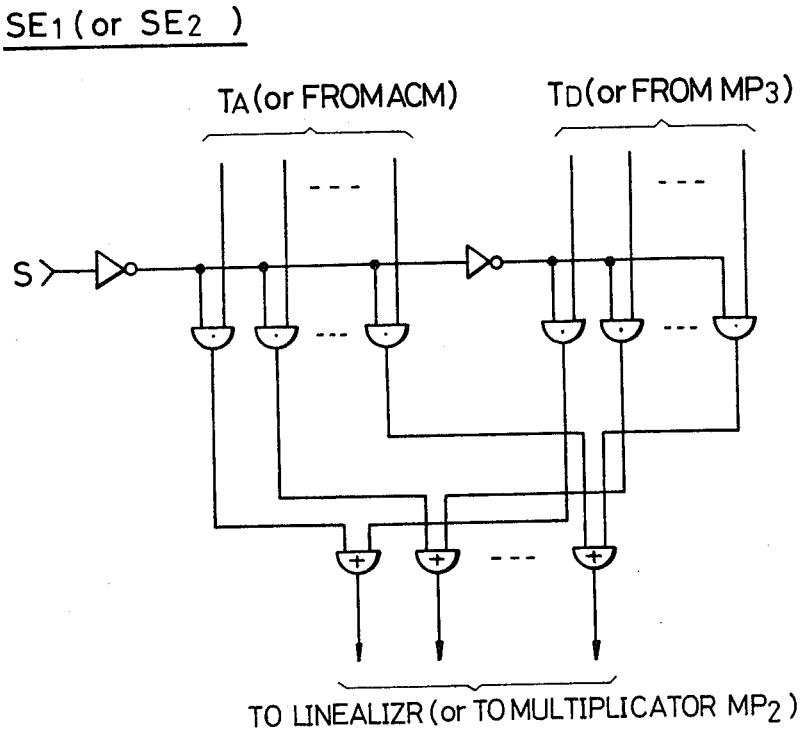
FIG. 10 is a circuit diagram showing the selection circuit $SE_1$ of FIG. 3 and concurrently the selection circuit $SE_2$ (reference characters appearing in parentheses)

FIG. 1 is a graph showing the change occuring with the lapse of time in the envelope of a musical tone harmonic level in an embodiment of the electronic musical instrument according to the invention. In the figure, the rise portion at the start of the tone is designated by A which denotes the attack portion of the envelope whereas the immediately following fall portion is designated by D which denotes a decay portion of the envelope. The change in the level signifies change in the tone color. Accordingly, a constant tone color is maintained in the sustain envelope portion S continuing from the decay portion D. A second decay portion which starts upon release of the key is designated as the release portion R. In the release portion R, level control by each harmonic is not effected. The present embodiment of the electronic musical instrument is constructed in such a manner that time $T_A$ for the attack envelope portion A, time $T_D$ for the decay envelope portion D, an attack peak level L and a sustain level PS (or PS') are controlled independently from each other and for each harmonic so that the levels of each harmonic in the attack and decay portions are controlled independently at the start of reproduction of the tone.

Figure 2:
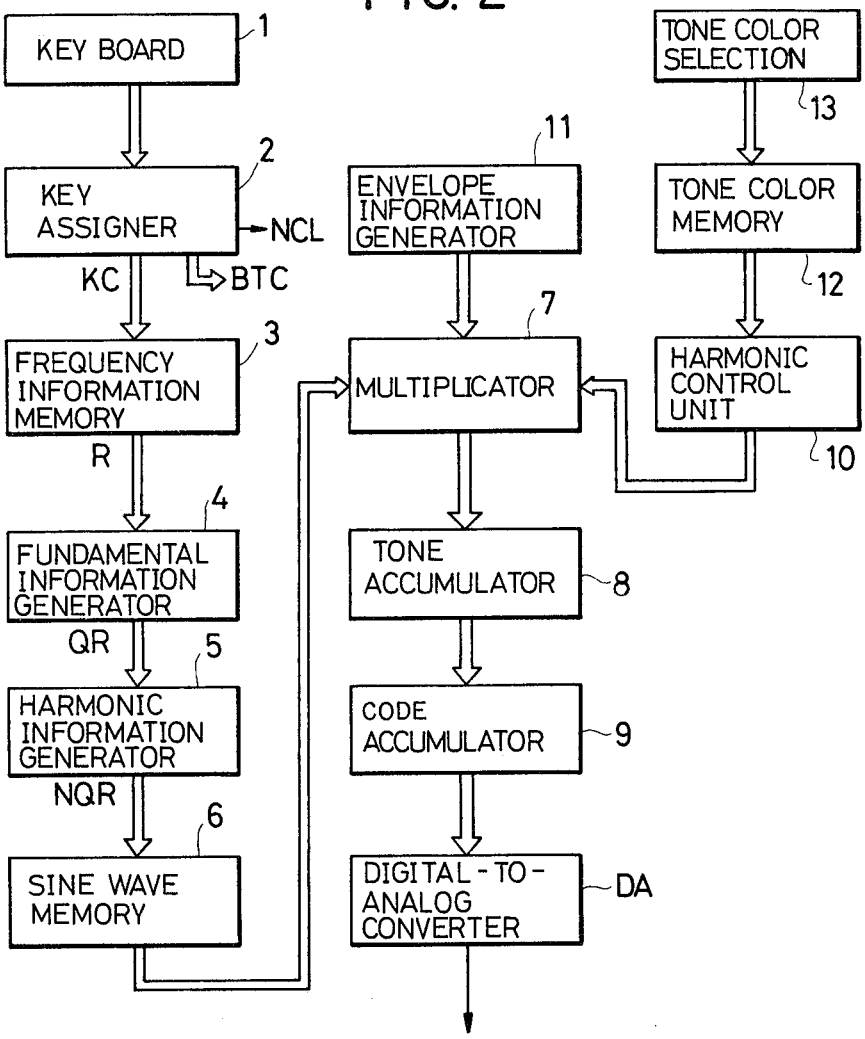
FIG. 2 is a block diagram showing one embodiment of the electronic musical instrument according to the invention.

Referring to FIG. 2, a key assigner 2 produces a key address code KC representing the key name of a depressed key in response to key-on information supplied from a keyboard circuit 1 and also produces various clock pulses or time-shared information used for controlling time-shared synchronized operation of respective units constituting the instrument according to the invention. Assume, for example, that the inventive electronic musical instrument uses higher harmonics up to the eighth harmonic and that a maximum number of tones to be reproduced simultaneously is eight. Clock pulses are counted by a first counter of eight stages (not shown) to form time sharing time slots for the respective harmonics and the frequency divided output of this counter is further counted by a second counter of eight stages (not shown) to form time sharing time slots for respective channels corresponding in number to the maximum number of tones to be reproduced simultaneously. The output of the first counter is hereinafter referred to as a degree-of-harmonic signal BTC. This signal BTC is utilized in a tone color memory 12 as will be described later. The key assigner 2 provides the various units with signals representing key-on and key-off for producing various envelope signals.

A frequency information memory 3 previously stores frequency information R which is a value proportionate to the frequency of each tone. Frequency information R corresponding to the depressed key is read out in response to contents of key address code KC. Fundamental information generator 4 cumulatively counts the frequency information R to produce fundamental information QR required for forming harmonic information. This causes the phase of the fundamental wave to be determined. The fundamental information QR is produced in a time sharing manner with respect to each of the eight tones. The output of the fundamental information generator 4 is applied to a harmonic information generator 5. In the harmonic information generator 5, while the fundamental information QR assumes a certain value, it is cumulatively counted at a rapid time sharing rate corresponding to the above described signal BTC, whereby address information NQR at each sample point used for reading out waveshape information of eight harmonics for each tone is sequentially produced. (The eight harmonics include the fundamental wave.) Thus the phases of the respective harmonics are determined.

Amplitude information of a sine wave at required sample points are read from a sine wave memory 6 in a time sharing manner in response to the address information NQR for the eight harmonics of each tone, whereby the amplitude information of the respective harmonics (including the fundamental wave) is obtained.

The above described construction is the same as the one described in U.S. Pat. No. 3,809,786 granted May 7, 1974, so that detailed description thereof is omitted. The construction and operation of the key assigner 2 are described in the copending U.S. patent application Ser. No. 448,583 now U.S. Pat. No. 3,903,775 granted Sept. 9, 1975 and of common assignment herewith.

In a multiplicator 7, this amplitude information for each harmonic is multiplied with envelope control information for each harmonic applied from an envelope information generator 11 for controlling the overall level of each harmonic of the musical tone and with harmonic level information applied from a harmonic control unit 10 to produce harmonic amplitude information which is controlled in tone color and overall entire envelope level in a time sharing manner.

This amplitude information for each harmonic is applied to a tone accumulator 8 where the amplitudes of the fundamental wave up to the eighth (*n*-th) harmonic are added together for each musical tone and amplitude information of each musical tone is thereby formed. Further, in a code accumulator 9, amplitude information of a plurality of tones is added together by each keyboard and thereafter is provided as an analog musical signal through a digital-to-analog converter DA.

A tone color memory 12 previously stores information corresponding to the time $T_A$ for the attack envelope, the time $T_D$ for the decay envelope, the peak level L and the sustain level PS for each harmonic. The stored information for each harmonic is read out in time sharing in response to the degree-of-harmonic signal BTC. Several kinds of information are stored in the tone color memory 12 for each of the information corresponding to $T_A$, $T_D$, L and PS to enable the performer to select kinds of information which will achieve a desired tone color effect by operation of a tone color selection switch 13. The harmonic control unit 10 generates, in response to the read out information for $T_A$, $T_D$, L and PS, envelope level control information with rise and fall portions which change with the lapse of time as shown in FIG. 1.

Figure 3:
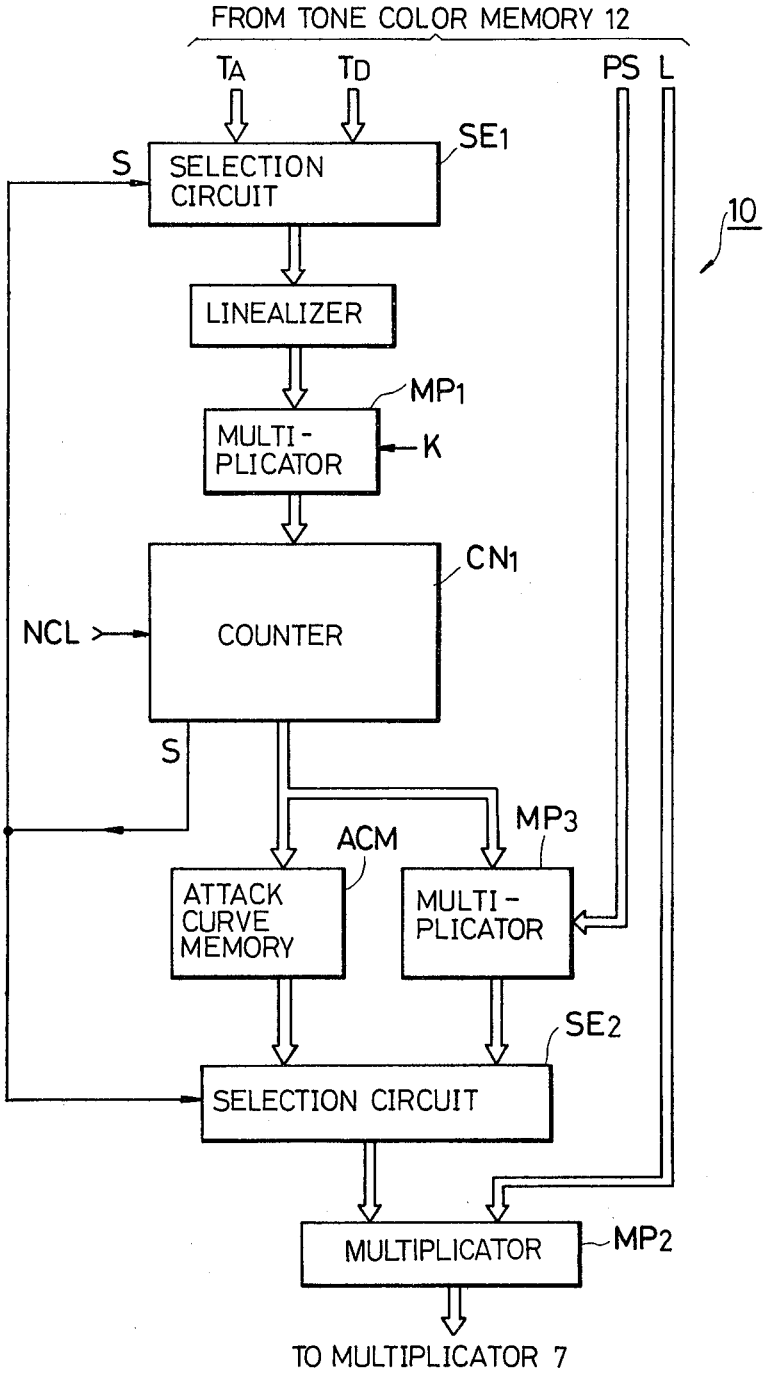
FIG. 3 is a block diagram showing in detail a harmonic control unit shown in FIG. 2.

FIG. 3 shows an example of the harmonic control unit 10 in detail. Attack time information $T_A$ and decay time information $T_D$ among the information read from the tone color memory 12 are applied to a selection circuit $SE_1$. The selection circuit $SE_1$ selects either one of the information $T_A$ or $T_D$ in accordance with a selection signal S and supplies the selected information to a multiplicator $MP_1$. The selection signal S is applied from an attack decay counter $CN_1$ in such a manner that the attack time information $T_A$ will be selected when the counter $CN_1$ is in an attack mode and the decay time information $T_D$ will be selected when the counter $CN_1$ is in a decay mode. A new claim signal NCL which represents that a key has been newly depressed (start of reproduction of a tone) is applied from the key assigner 2 to the counter $CN_1$ to reset the contents of counting. The selection circuit $SE_1$ first selects the attack time information $T_A$. Since the information $T_A$ and $T_D$ from the memory 12 expresses information corresponding to the attack and decay times in logarithmic scale, the information is converted to values in linear scale by a linealizer before multiplying it by a constant K in the multiplicator $MP_1$. Accordingly, linearly indicated time information $T_A$ and $T_D$ is supplied to the counter $CN_1$.

In the counter $CN_1$ counting is effected at rates corresponding to the information $T_A$ and $T_D$. If the information $T_A$ and $T_D$ is relatively of a large value, the speed of increase of the counted value is high, whereas if the information $T_A$ and $T_D$ is of a small value, the speed of increase is low. If for example, the information $T_A$ is 2, the counted value increases 2, 4, 6, 8 . . . . If the information $T_A$ is 3, the counted value increases 3, 6, 9 . . . . The counting output of the counter $CN_1$ is used as addresses for reading out fundamental level information at corresponding sample points on an attack curve (i.e. a curve which constitutes the basis of the envelope) stored in an attack curve memory ACM: Accordingly, reading rate of the memory ACM is controlled in accordance with the attack time information $T_A$ with a result that the attack time (rise time) is virtually controlled.

The output of the memory ACM is selected by a selection circuit $SE_2$ and thereafter is supplied to a multiplicator $MP_2$. The multiplicator $MP_2$ also receives the peak level information L read from the tone color memory 12. Thus, the attack curve level information and the peak level information L are multiplied with each other. This enables the level information at the respective sample points on the attack curve to be adjusted in its rate in accordance with the peak level information and level information of the attack envelope A is thereby produced. If the information read from the attack curve memory ACM and the tone color memory 12 is expressed in a logarithmic scale, the multiplicator $MP_2$ may be replaced by an adder. The selection circuit $SE_2$ is selectively controlled by the selection signal S in the same manner as has been described with respect to the selection circuit $SE_1$.

When the counted value of the counter $CN_1$ has amounted to a predetermined value and reading of the attack curve has been completed, the decay time information $T_D$ is selected in the selection circuit $SE_1$. The selection signal S is formed by, for example, a signal of the most significant bit in the counted values of the counter $CN_1$. When the selection signal S is "0," attack is selected and, when the selection signal S becomes "1," decay is selected. When the information $T_D$ is applied to the counter $CN_1$, the counter CN performs counting in the same manner as in the case where it receives the information $T_A$. Accordingly, the counted value of the counter CN increases at a rate corresponding to the decay time information $T_D$. Since the most significant bit of the counted value is utilized not as a counting output but as the selection signal S only, counting in the counter $CN_1$ after the information $T_D$ is applied thereto is substantially the same as if it started from zero.

In the present embodiment, a multiplicator $MP_3$ is used for obtaining level information required for producing the decay envelope D. In the multiplicator $MP_3$ the counting output of the counter $CN_1$ is multiplied with the sustain level information PS read from the memory 12, the counting output being regarded as a logarithmically expressed value. Since the information PS is also a logarithmically expressed value, the multiplicator $MP_3$ may be replaced by an adder. If the level information for the respective harmonics of a tone represents amount of attenuation, count "0" of the counter $CN_1$ corresponds to attenuation "0," i.e., the peak level L. The gradually increasing counted value is multiplied with a constant sustain level information PS (this level PS represents an amount of attenuation) with a resultant increase in the amount of attenuation and decrease in the level. Thus the decay envelope D is produced. The output of the multiplicator $MP_3$ is applied through the selection circuit $SE_2$ to the multiplicator $MP_2$ where it is multiplied with the peak level information L. When the counted value of the counter $CN_1$ has reached a predetermined value, the decay envelope D is completed. Since the amount of attenuation in the decay envelope D does not exceed the sustain level PS, the multiplier for the sustain level in the multiplicator $MP_3$, i.e., the counting output of the counter $CN_1$ can be regarded as a value below radix point.

When the counted value of the counter $CN_1$ has amounted to a value which can be regarded as multiplier 1 to the sustain level PS, the decay envelope D is completed. After completion of the decay envelope D, the sustain level PS is maintained whereby the sustain state S is obtained.

In the above described manner, the attack and decay level information is sequentially delivered from the multiplicator $MP_2$. The level information is produced in time sharing by each harmonic and by each of the maximum number of tones to be reproduced simultaneously. The counter $CN_1$ therefore is sufficiently capable of carrying out the counting operation for the respective (the first through the eighth) harmonics and for each of the eight tones.

The tone color memory 12 may be provided in each of an upper keyboard, lower keyboard and a pedal keyboard with the contents of storage of these memories 12 being made different from each other. Information $T_A$, $T_D$, L and PS is selected from the memory 12 of a desired keyboard in accordance with keyboard information provided by the key assigner 12 and representing the kind of keyboard of the depressed key and applied to the harmonic control unit 10. According to this arrangement, different modes of tone color change can be produced for the same note depending upon the selected keyboard.

The construction of the harmonic control unit is not limited to the above described example but any construction will suffice if it can produce the attack and decay envelopes in accordance with the attack time information $T_A$, decay time information $T_D$, peak level information L and sustain level information PS all of which are determined and read out independently from each other. For example, the harmonic control unit 10 may comprise a counter in which counting is effected at a rate corresponding to the time information $T_A$ and $T_D$, means for generating basic attack and decay level information in response to the counting output of this counter, means for multiplying the basic level information with the peak level information L and means for detecting decaying of thus obtained level information down to the sustain level PS and thereupon finishing the decaying. The construction of the harmonic control unit 10 may be suitably modified if the sustain level PS' shown in FIG. 1 is used. An electronic musical instrument in which this harmonic control unit 10 is used is not limited to the construction shown in FIG. 2 but the harmonic control unit 10 may be used in any digital type electronic musical instrument.

Figure 4:
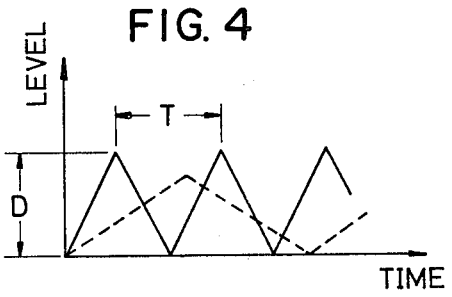
FIG. 4 is a graphic diagram showing an example of an amplitude-modulation signal used in another embodiment of the invention for affording change to the level of each harmonic.
Figure 7:
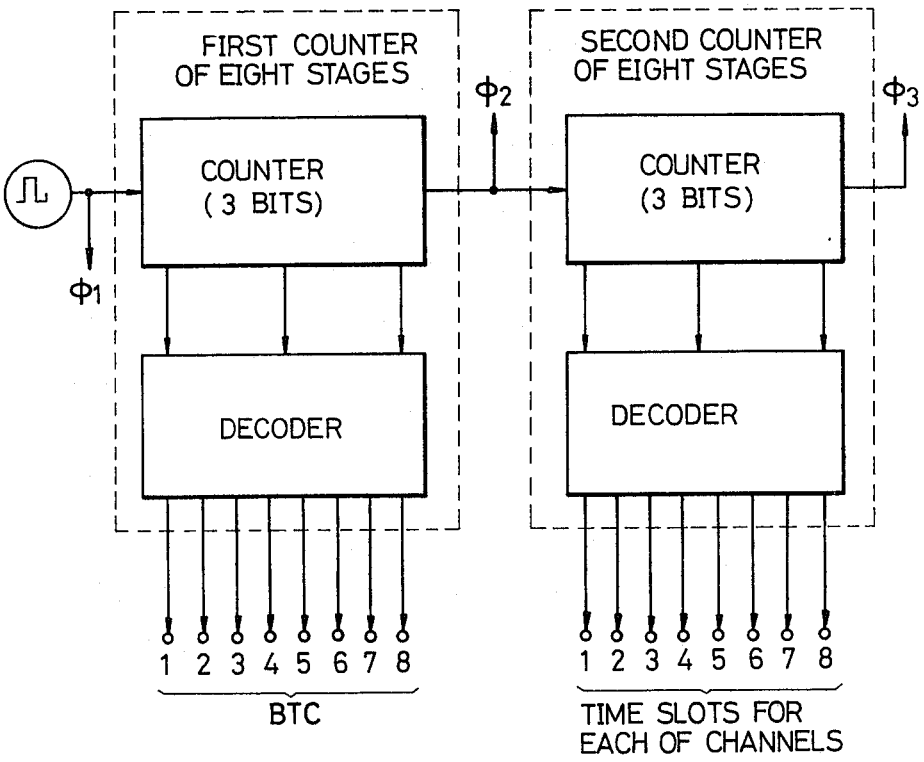
FIG. 7 is a detailed circuit diagram showing a circuit for producing clock pulses $\phi_2$, $\phi_3$, signal BTC and pulses appearing in time slots corresponding to the respective channels from clock pulse $\phi_1$.
Figure 5:
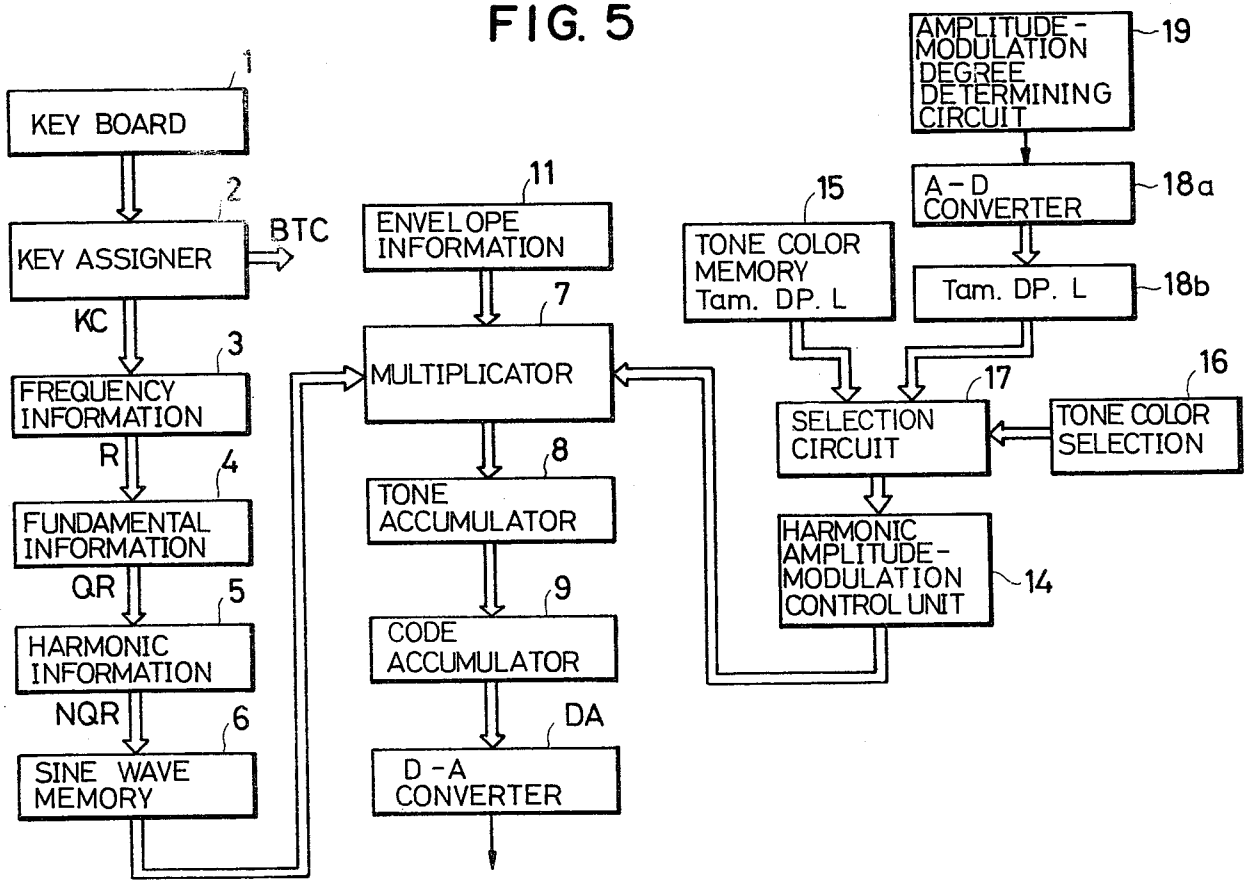
FIG. 5 is a block diagram showing another embodiment of the electronic musical instrument according to the invention.
Figure 6:
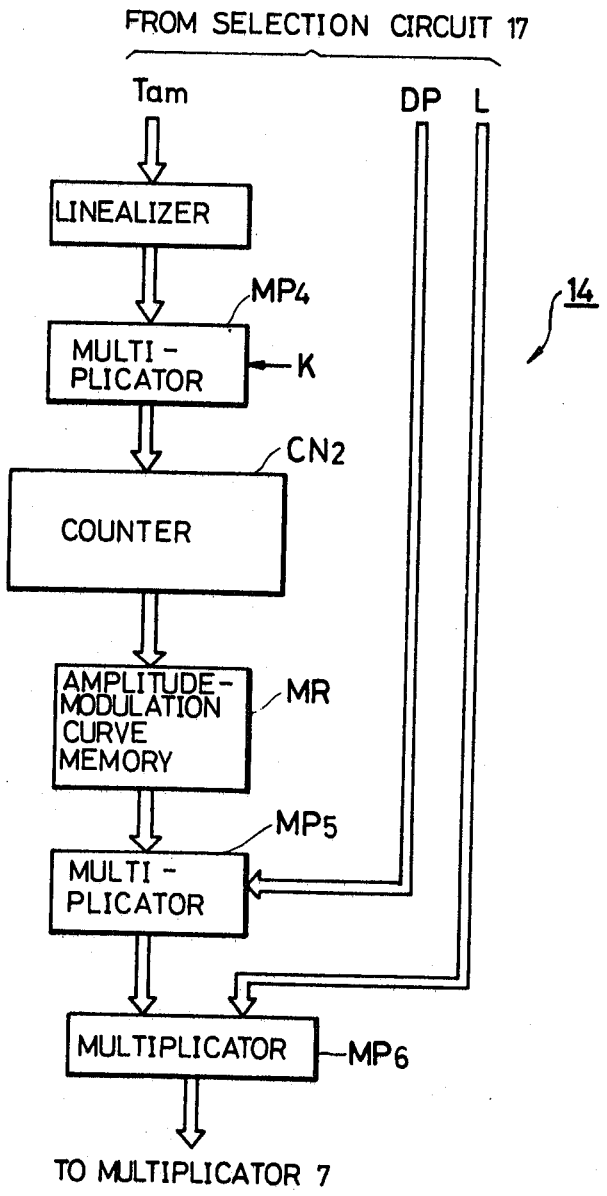
FIG. 6 is a block diagram showing in detail a harmonic amplitude-modulation control unit shown in FIG. 5.
Figure 8:
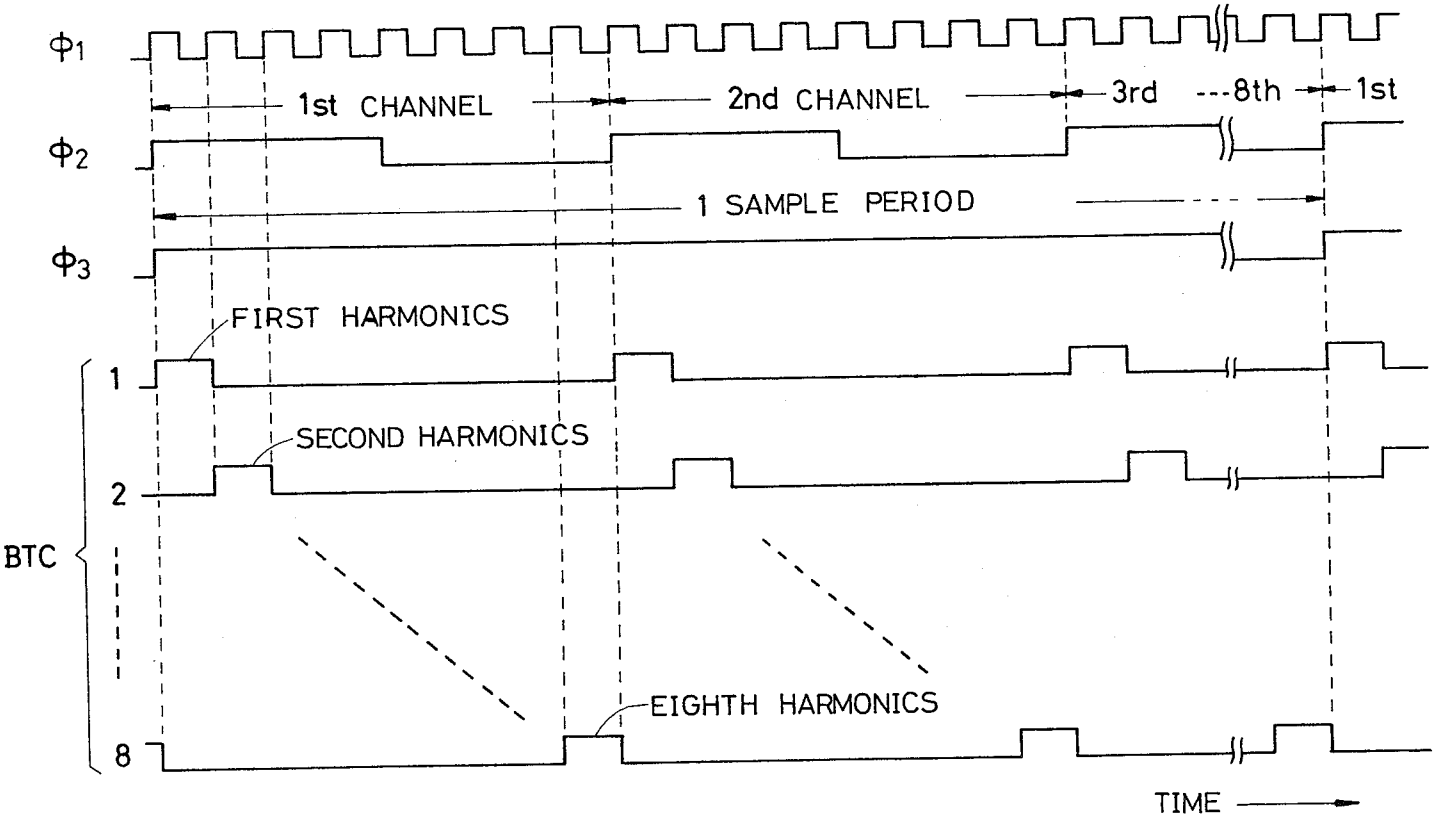
FIG. 8 is a timing chart showing relations between the signal BTC and the clock pulses $\phi_1$, $\phi_2$ and $\phi_3$.
Figure 9:
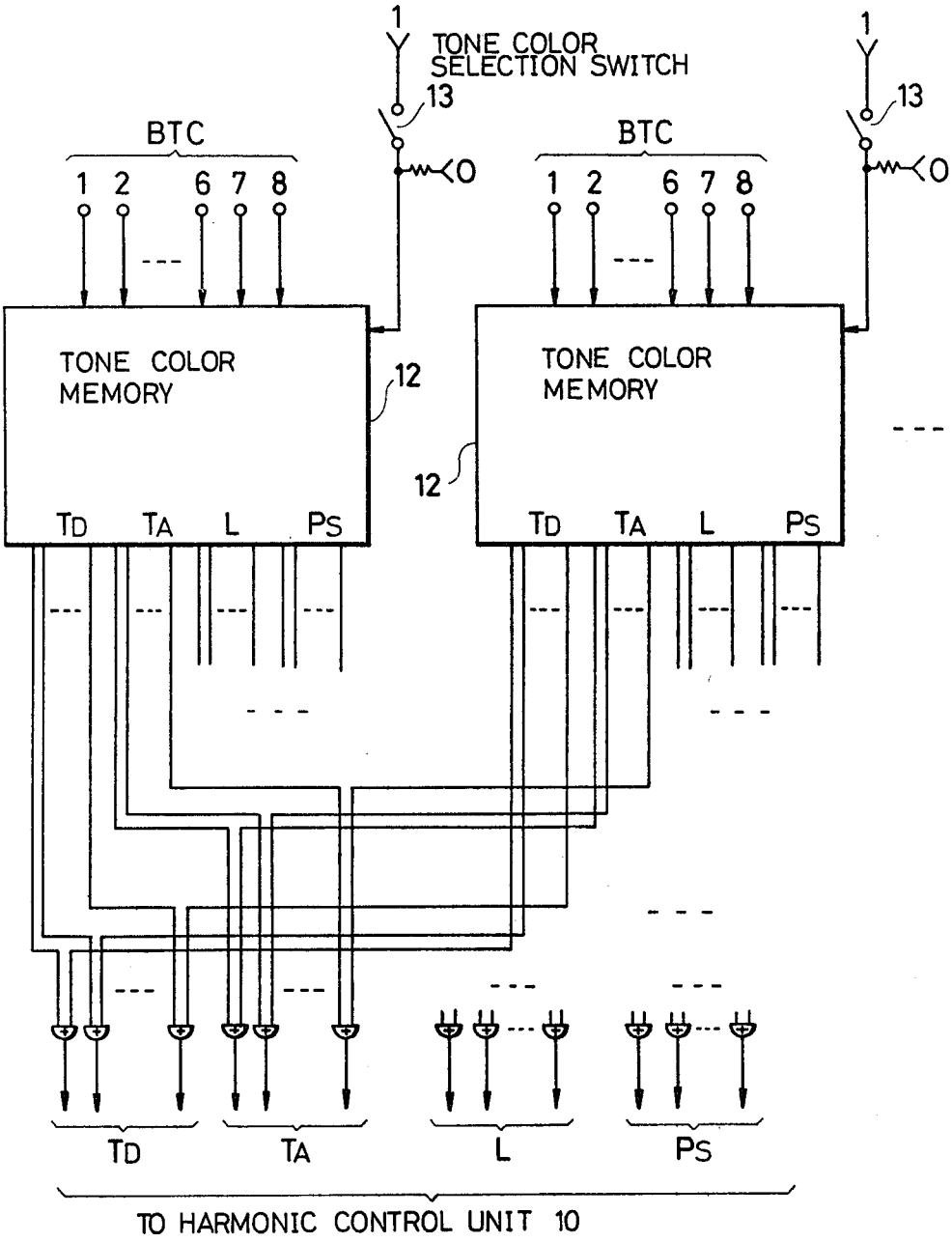
FIG. 9 is a circuit diagram showing tone color selection switches 13 and tone color memories 12 in detail.
Figure 11:
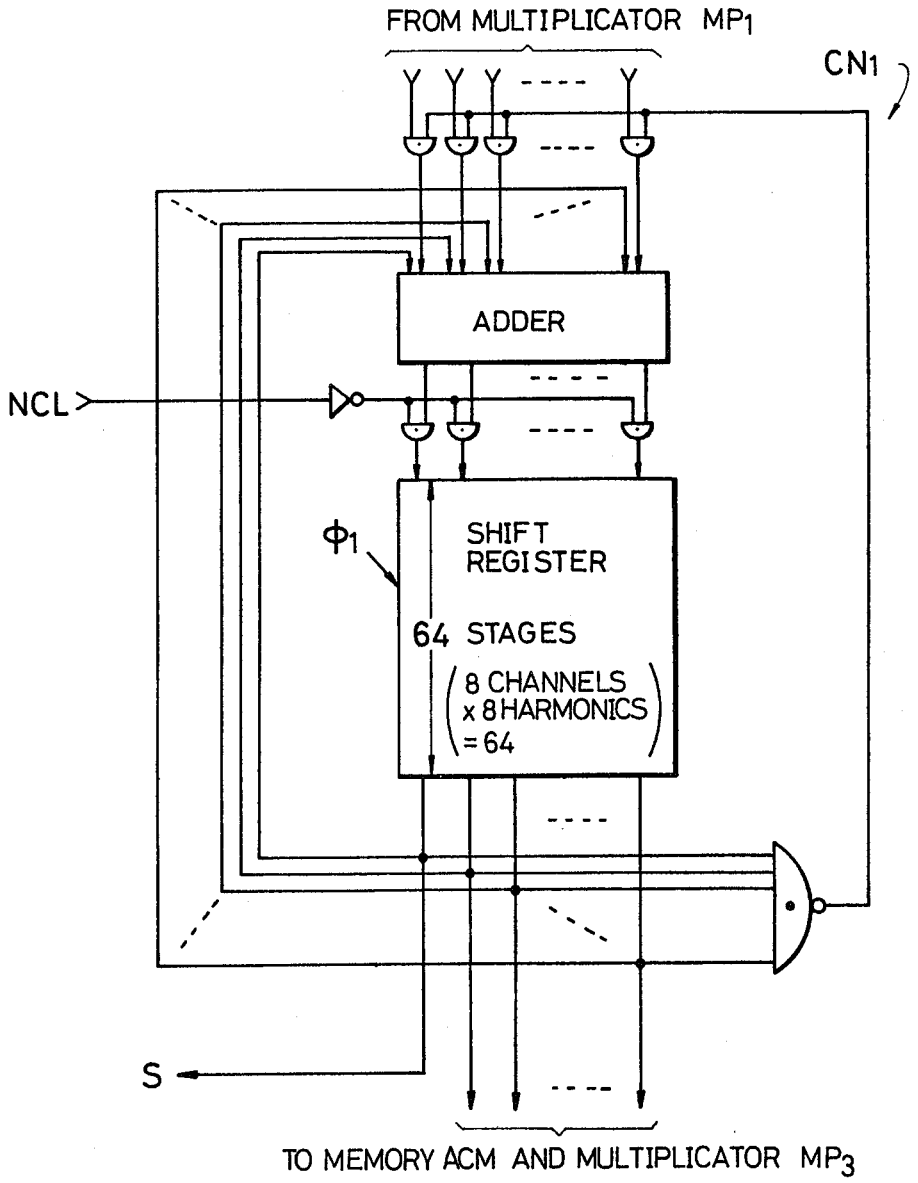
FIG. 11 is a circuit diagram showing the counter $CN_1$ of FIG. 3 in detail.
Figure 12:
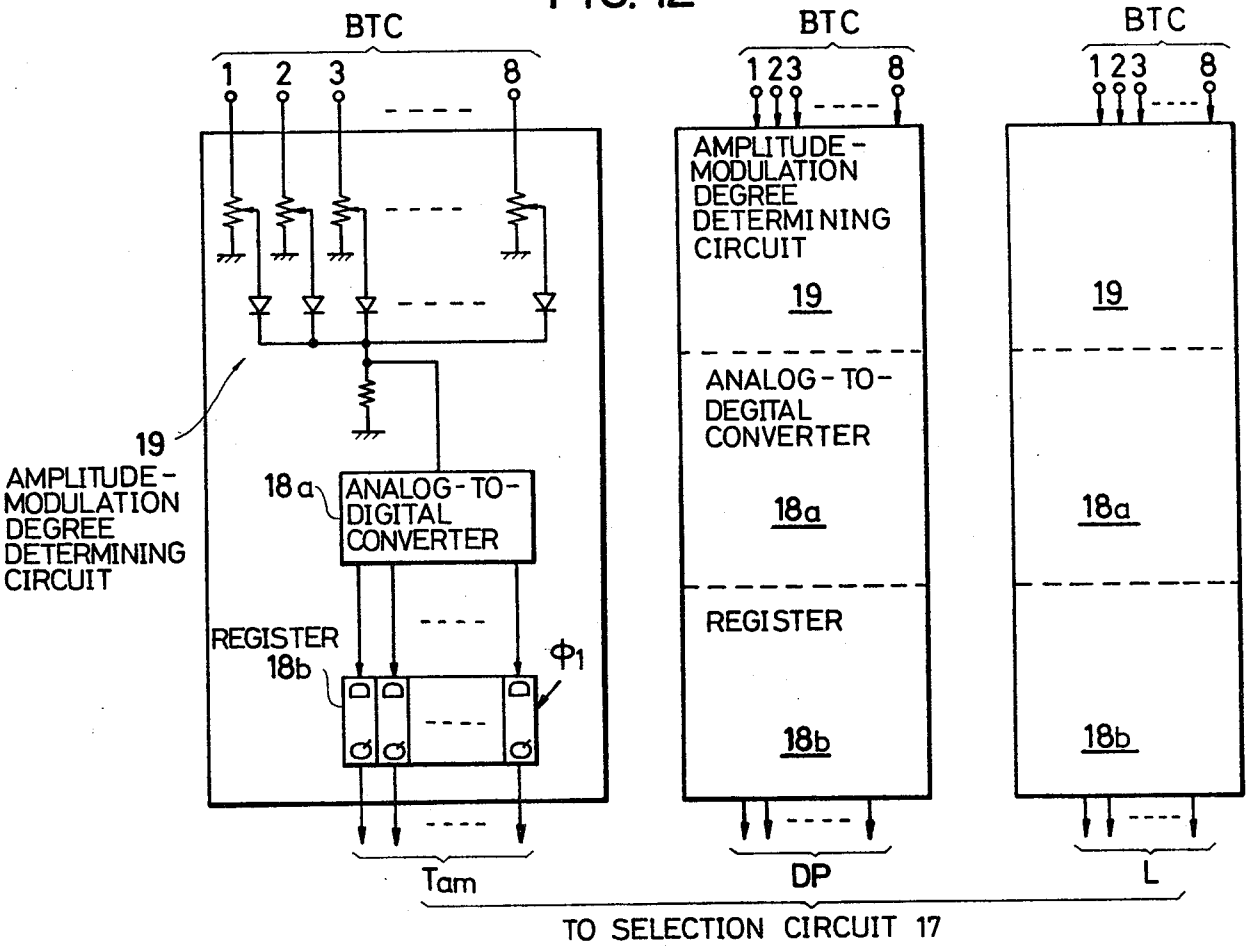
FIG. 12 is a circuit diagram showing the amplitude-modulation degree determining circuit 19, the analog-to-digital converter **18*a* and the register 18*b* in detail.
Figure 13:
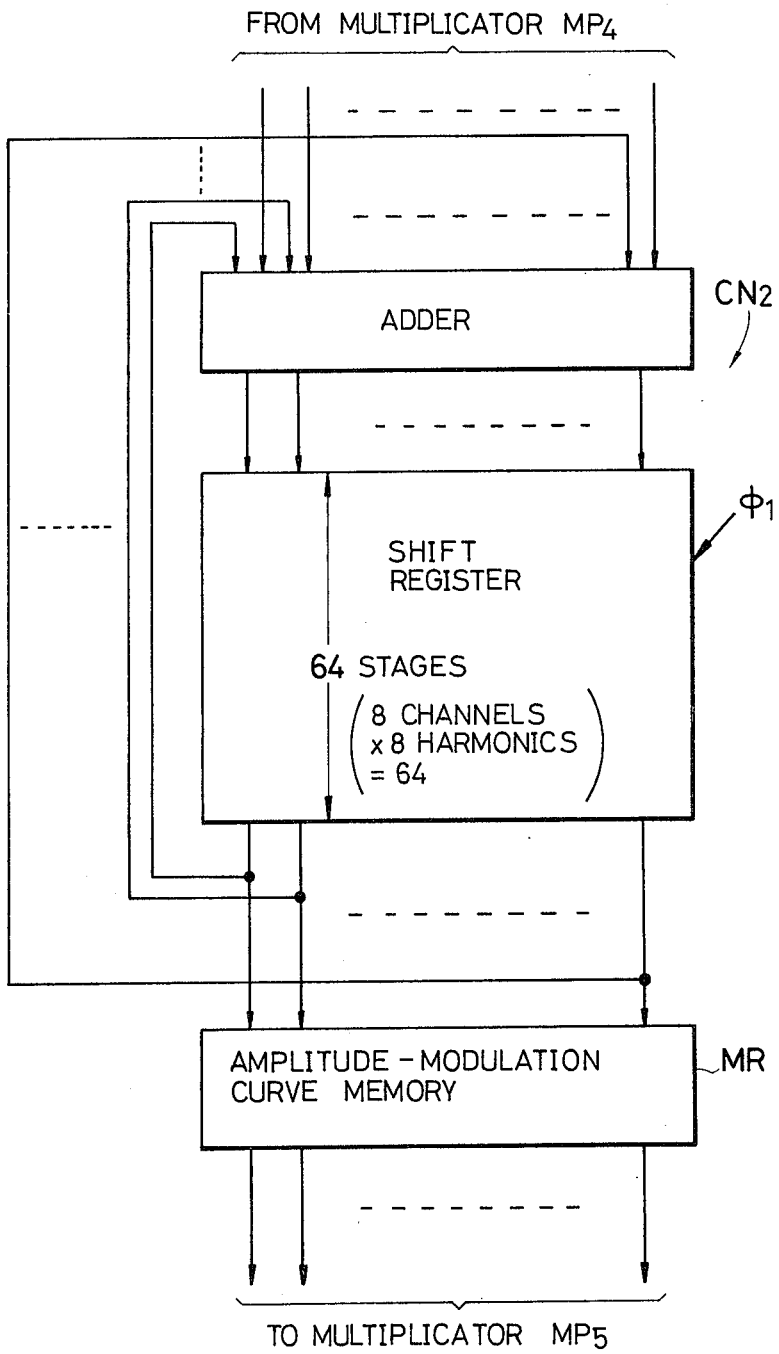
FIG. 13 is a circuit diagram showing the counter $CN_2$ of FIG. 6** in detail.

FIGS. 4 through 6 show another embodiment of the electronic musical instrument according to the invention. This embodiment is different from the previously described embodiment in that the level of each harmonic is caused to change with a predetermined period depth.

FIG. 4 illustrates an example of a waveshape used for amplitude-modulating the level of each harmonic with a suitable period T and depth D. The period T (i.e. rate of amplitude-modulation) and depth D are determined at suitable values for each harmonic. In the figure, the full line shows change in control level of the fundamental (the first harmonic) and the broken line that of the second harmonic. It will be apparent from the figure that the rate of amplitude-modulation is different for each harmonic. This arrangement produces what may be termed a multiple system effect in which the rate of amplitude-modulation is different for each harmonic. Furthermore, a vibraphone effect may be produced by changing the amplitude-modulation levels of the respective harmonics simultaneously.

FIG. 5 is a block diagram schematically showing the embodiment in which the level of each harmonic changes with a predetermined period. Various information used in this embodiment is digitally processed and finally converted to an audio signal through a digital-to-analog converter DA. The most important component part of this embodiment is a harmonic amplitude-modulation control unit 14 which is provided for digitally controlling the amplitude-modulation. Other component parts of this embodiment are substantially the same as those described with reference to the first embodiment so that description thereof will be omitted.

Amplitude information at required sample points on a sine wave stored in a sine wave memory 6 is read out in a time sharing manner in response to address information NQR for each of the eight harmonics and for each of the eight tones. The read out information constitutes amplitude information for the respective harmonics including the fundamental. In a multiplicator 7, this amplitude information is multiplied with various envelope control information such as attack, decay, sustain and release supplied from an envelope information generator 11 and with respective harmonic level control information supplied from a harmonic amplitude-modulation control unit 14 to produce in time sharing musical tone amplitude information which has been controlled in the tone color and envelope. This musical tone amplitude information is applied to a tone accumulator 8 where the amplitudes of the fundamental up to the eighth (*n*-th) harmonic are added together. This constitutes amplitude information for a particular musical tone. In a code accumulator 9, the amplitudes of the respective tones are added together by each keyboard. The output of the code accumulator is converted to an analog audio signal through a digital-to-analog converter DA. Since the amplitude information read from the sine wave memory 6 is expressed in a linear scale, the construction of the multiplicator 7 can be simplified by expressing the envelope control information and the harmonic level information in a decibel scale. Further, it is to be noted that operations of the component parts are synchronized with each other with respect to the same degree of harmonic in the same channel.

A tone color memory 15 is provided for determining and storing various information required for achieving a desired tone color. In the present embodiment, amplitude-modulation rate (i.e. period T) information Tam, depth information DP and level information L for obtaining a predetermined tone color for each harmonic are stored in the tone color memory 15. Several kinds of information are stored for each of such information Tam, DP and L so that a desired kind of information may be selected by operation of a tone color selection switch 16. The respective information Tam, DP and L stored in the tone color memory 15 is read out in a time sharing manner for each harmonic in response to the degree-of-harmonic signal BTC. In the time slot for the fundamental, for example, the information Tam, DP and L for the fundamental is simultaneously read out.

The amplitude-modulation rate T, depth D and the constant level are determined at desired values by an amplitude-modulation degree determining circuit 19 which is composed of, e.g. variable resistors. More specifically, time-shared pulses are applied to variable resistors provided in correspondence to the respective harmonics in response to the degree-of-harmonic signal BTC to read out values set for each harmonic in time sharing. The read out values are converted to corresponding digital information Tam, DP and L through an analog-to-digital converter 18*a* and thereafter are supplied to a selection circuit 17 through a register 18*b*. In the selection circuit 17, information Tam, DP and L supplied either from the tone color memory 15 or the register 18*b* are selected in accordance with operation of a selection switch 16 and supplied thereafter to the harmonic amplitude-modulation control unit 14. The information Tam, DP and L is expressed in a logarithmic scale.

FIG. 6 shows one example of the harmonic amplitude-modulation control unit 14. The control unit 14 produces level control waveshape information used for amplitude-modulating the levels of the respective harmonics in response to the information Tam, DP and L and supplies the level control waveshape information to the multiplicator 7. The amplitude-modulation rate information Tam expressed in a logarithmic scale is converted to information in a linear scale by a linealizer and applied to the multiplicator $MP_4$ where it is multiplied with a required constant K. The resulting linear rate information Tam is applied to a counter $CN_2$. The counter $CN_2$ effects counting at a counting rate corresponding to the rate information Tam. If, for example, the information Tam is 2, counting proceeds 2, 4, 6, 8 . . . . If the information Tam is 3, counting proceeds 3, 6, 9 . . . . Thus, the contents of counting increase at a speed corresponding to the magnitude of the amplitude-modulation rate information Tam and the period T shown in FIG. 4 is thereby controlled as will be described more in detail later.

The counting operation of the counter $CN_2$ is started or stopped in accordance with a signal supplied from the key assigner 2. If, for example, the counting operation is so controlled that counting starts when reproduction of the musical tone has undergone the attack and decay states and entered the sustain state, a tone color effect according to the present invention is produced only in the sustain state in which the tone color is constant. If the counting operation is so controlled that counting starts when reproduction of the musical tone has undergone the sustain state and entered the release (attenuation) state, a tone color effect according to the present invention (e.g. a vibraphone effect) is produced only in the attenuating portion of the tone. The counter $CN_2$ has a capacity sufficient for carrying out the counting operation for the respective harmonics (e.g. the first to the eighth) and for each of the maximum number of tones to be reproduced simultaneously (e.g. 8). If the counting output of the counter $CN_2$ consists of 12 bits, the counter $CN_2$ has a capacity of $8 \times 8 = 64$ words (1 word = 12 bits).

The counting output of the counter $CN_2$ produced in time sharing for each harmonic of each tone is used as address information for reading out data at each sample point on an amplitude-modulation curve stored in an amplitude-modulation curve memory MR. The memory MR stores basic data at each sample point on one period of waveshape such as shown in FIG. 4 (e.g. a triangle wave or a sine wave) in a logarithmic scale. As the counter $CN_2$ counts from 0 to a predetermined count (i.e. a maximum count), one period of the waveshape is formed by the read out data. This counting operation is repeated and a continuous waveshape (i.e. the amplitude-modulation curve) used for amplitude-modulation is formed. Accordingly, the period T of this waveshape is controlled in accordance with the speed of increase of the counted value which is used as the address information and, consequently, in accordance with the value of the amplitude-modulation rate information Tam. In the foregoing manner, the rate of the amplitude-modulation is controlled.

The amplitude-modulation curve read from the memory MR is applied to a multiplicator $MP_5$ where it is multiplied with the depth information DP supplied from the selection circuit 17 (FIG. 5). The depth information DP is used for controlling the depth D of amplitude-modulation and the depth (amplitude) of the amplitude-modulation curve is determined in accordance with the depth information DP. If, for example, the depth information DP of the fundamental is made different from that of the second harmonic, the fundamental and the second harmonic have different depths of amplitude-modulation as illustrated by the full line and the broken line in FIG. 4. Since all component parts of the instrument operate in time-shared synchronization, the degree of harmonic for data read from the memory MR in a certain time slot is the same as the degree of harmonic for information DP supplied from the selection circuit 17. Since the two inputs to the multiplicator $MP_5$ are expressed in a logarithmic scale, the multiplicator $MP_5$ may be replaced by an adder.

In the foregoing manner, periodically changing harmonic level control waveshape information with its amplitude-modulation rate (period) and depth determined by each harmonic is obtained. The waveshape information is applied to a multiplicator $MP_6$ where it is multiplied with a constant level information L supplied from the selection circuit 17. This level information is a value corresponding to the relative level ratio of each harmonic and has been used in the past for producing a constant tone color. Accordingly, the harmonic level control waveshape information supplied from the multiplicator $MP_5$ is uniformly controlled in its entire level in accordance with the level information L in the multiplicator $MP_6$ and thereafter is applied to the multiplicator 7. The multiplicator $MP_6$ may also be replaced by an adder for the previously described reason.

In the multiplicator 7, the level of each harmonic signal read from the sine wave memory is individually amplitude-modulated in accordance with the harmonic level control waveshape information supplied from the harmonic amplitude-modulation control unit 14 which changes as shown in FIG. 4.

The harmonic amplitude-modulation control unit 14 is applicable not only to the electronic musical instrument as shown in FIG. 5 but to any type of musical instrument which digitally generates musical tone information. The harmonic amplitude-modulation control unit 14, tone color memory 15, amplitude-modulation degree determining circuit 19, selection circuit 17 and selection switch 16 are not limited to the above described construction but any construction will suffice if it can produce periodically changing amplitude-modulation information (waveshape information as shown in FIG. 4) by each harmonic and change the period T and the depth D of such information as desired.

According to this embodiment, the level of each harmonic constituting a musical tone is individually amplitude-modulated and the period (i.e. modulation rate) and the depth of modulation are variable controlled so that various tone color effects including "multi system effects" and "vibraphone effect" can be achieved.

The circuit for generating the signal BTC and the time slot pulses for the respective channels, tone color selection switches 13, tone color memory 12, selection circuit $SE_1$, $SE_2$, counter $CN_1$, amplitude-modulation degree determining circuit 19, analog-to-digital converter 18*a*, register 18*b* and counter $CN_2$ are known per se and specific example of these component parts are illustrated in FIGS. 7–13.

What is claimed is:

1. An electronic musical instrument comprising:

a tone color memory having separately stored therein for each harmonic of a musical tone first information representing the attack peak level of the attack portion of the envelope for the harmonic, second information representing the attack time which elapses from the start of the generation of the musical tone to the attack peak level, third information representing the sustain level of the sustain portion of the envelope, and fourth information representing the decay time which elapses from said peak level to the start of said sustain portion;

a harmonic control unit for sequentially producing, for each harmonic, attack envelope level information in response to said separately stored first and second information and decay envelope level information in response to said separately stored third and fourth information; and means responsive to the attack envelope level information and decay envelope level information produced by said harmonic control unit for controlling separately, for each harmonic, the level of said attack portion and the level of the envelope decay portion occurring between said attack and sustain portions, whereby the envelopes for the respective harmonics of the musical tone are provided with dissimilar shapes from the start of the generation of the musical tone to the start of said sustain portions.

2. An electronic musical instrument as defined in claim 1 wherein said harmonic control unit comprises;

a first selection circuit for selecting, for each harmonic, either said attack time information or said decay time information for each harmonic in response to a selection signal;

a multi-channel counter performing counting at a counting rate corresponding to the attack or decay time information for each harmonic selected by said first selection circuit;

an attack curve memory for storing a basic attack curve;

means for reading out basic level information at respective sample points on the basic attack curve for each harmonic in response to the counting output of said counter;

a first multiplicator for producing decay envelope information which gradually decreases in its level for each harmonic by multiplying counted values of said counter with a constant sustain level;

means for producing said selection signal for each harmonic from the most significant bit of each channel of said counter;

a second selection circuit for selecting, for each harmonic, either said basic level information or said decay envelope information in response to said selection signal; and a second multiplicator for multiplying, for each harmonic, the information selected by said second selection circuit with the peak level information.

3. An electronic musical instrument as defined in claim 5 wherein said tone color memory stores sets of information equal in number to kinds of tone colors to be produced, one set of said information consisting of information respectively representing an attack peak level, attack time from the start of generation of the tone to the peak level, a sustain level and decay time from the peak level to the start of the sustain level, and the instrument further comprises a tone color selection switch for selecting a particular tone color from said tone color memory.

4. An electronic musical instrument comprising;

a memory in which one period of a waveshape is stored as a basic curve of amplitude-modulation to be applied to each harmonic constituting a musical tone;

means for determining a given period and depth of amplitude of said waveshape for each harmonic;

means for reading waveshape information from said memory at a rate corresponding to the given period;

means for producing waveshape information controlled in its period and depth by multiplying the waveshape information read from said memory with information of the given depth; and means for controlling the level of each harmonic in accordance with said waveshape information controlled in its period and depth;

whereby the levels of the respective harmonics are amplitude-modulated with different periods and depths.

* * * * *